United States Patent [19]

Beck et al.

[11] Patent Number: 4,968,658

[45] Date of Patent: Nov. 6, 1990

[54] THERMAL TRANSFER RECEIVER

[75] Inventors: Nicholas C. Beck, Manningtree; John A. Pope, Colchester; Richard A. Hann, Ipswich, all of England

[73] Assignee: Imperial Chemical Industries plc, London, England

[21] Appl. No.: 433,780

[22] Filed: Nov. 8, 1989

[30] Foreign Application Priority Data

Nov. 11, 1988 [GB] United Kingdom ..... 8826457

[51] Int. Cl.[5] ..... B41M 5/035; B41M 5/26

[52] U.S. Cl. ..... 503/227; 8/471; 428/195; 428/447; 428/480; 428/482; 428/913; 428/914

[58] Field of Search ..... 8/471; 428/195, 480, 428/447, 913, 914, 482; 503/227

[56] References Cited

U.S. PATENT DOCUMENTS 4,097,230 6/1978 Sandhu ..... 428/480

FOREIGN PATENT DOCUMENTS 0228066 7/1987 European Pat. Off. ..... 503/227

*Primary Examiner*—Bruce H. Hess

*Attorney, Agent, or Firm*—Cushman, Darby & Cushman

[57] ABSTRACT

A receiver for dye diffusion thermal transfer printing comprises a substrate supporting a receiver coat comprising a dye-receptive material and a dye permeable release agent, characterized in that the receiver coat also contains dissolved or dispersed therein a Bisphenol A-based unsaturated polyester adhesive, to reduce printing adhesion.

7 Claims, No Drawings

THERMAL TRANSFER RECEIVER

The invention relates to thermal transfer printing, and especially to receiver sheets of novel construction and their use in dye-diffusion thermal transfer printing.

Thermal transfer printing ("TTP") is a generic term for processes in which one or more thermally transferable dyes are caused to transfer from a dyesheet to a receiver in response to thermal stimuli. For many years, sublimation TTP has been used for printing woven and knitted textiles, and various other rough or intersticed materials, by placing over the material to be printed a sheet carrying the desired pattern in the form of sublimable dyes. These were then sublimed onto the surface of the material and into its interstices, by applying heat and gentle pressure over the whole area, typically using a plate heated to 180°–220° C. for a period of 30–120 s, to transfer substantially all of the dye.

A more recent TTP process is one in which prints can be obtained on relatively smooth and coherent receiver surfaces using pixel printing equipment, such as a programmable thermal print head or laser printer, controlled by electronic signals derived from a video, computer, electronic still camera, or similar signal generating apparatus. Instead of having the pattern to be printed already preformed on the dyesheet, a dyesheet is used which comprises a thin substrate supporting a dyecoat comprising a single dye or dye mixture (usually dispersed or dissolved in a binder) forming a continuous and uniform layer over an entire printing area of the dyesheet. Printing is then effected by heating selected discrete areas of the dyesheet while the dyecoat is held against a dye-receptive surface, causing dye to transfer into the corresponding areas of that receptive surface. The shape of the pattern transferred is determined by the number and location of the discrete areas which are subjected to heating, and the depth of shade in any discrete area is determined by the period of time for which it is heated and the temperature reached. The transfer mechanism appears to be one of diffusion into the dye-receptive surface, and such printing process has been referred to as dye-diffusion thermal transfer printing ("DDTTP").

This process can give a monochrome print in a colour determined by the dye or dye-mixture used, but full colour prints can also be produced by printing with different coloured dyecoats sequentially in like manner. The latter may conveniently be provided as discrete uniform print-size areas, in a repeated sequence along the same dyesheet.

A typical receiver sheet consists essentially of a substrate coated with a dye-receptive layer of a composition having an affinity for the dye molecules and into which they can readily diffuse when the dyesheet is heated during printing. Such dye-receptive layers are typically around 2–6 μm thick. Various sheet materials have been suggested for the substrate, including for example, cellulose fibre paper, thermoplastic films such as biaxially orientated polyethyleneterephthalate film, and plastic films voided to give them paper-like handling qualities (hence generally referred to as "synthetic paper").

High resolution DDTTP can be effected by making the heated areas very small and close together, to transfer correspondingly small individual pixels, or groups of such pixels, to the receiver. For example, a typical thermal print head has a row of tiny heaters which print six or more pixels per millimetre, generally with two heaters per pixel. The greater the density of pixels, the greater is the potential resolution, but as presently available printers can only print one row at a time, it is desirable to print them at high speed with short hot pulses, usually from near zero up to about 10 ms, but even up to a maximum of 15 ms in some printers, with each pixel temperature typically rising to about 350° C. during the longest pulses.

However, such high temperatures can lead to local melt bonding between the dyesheet and the receiver, which in turn can cause large areas of the dyecoat (including binder) to be transferred to the receiver, in an unpredictable manner. The excess transferred material may appear as a discoloration, or as a matt area on an otherwise glossy surface. This unwanted phenomenon is sometimes referred to as "printing adhesion" (and is so referred in this specification), and sometimes as "total transfer". It has previously been suggested that the problem might be mitigated by using various crosslinked dye-permeable release agents in the receiver coat, but in practice, however, these have not always proved to be entirely successful, especially when using dyesheets employing the popular polyvinyl butyral binders for the dyes.

We have now found that by adding to the receiver coat certain selected materials which are normally sold as adhesives, we can minimise or even eliminate printing adhesion altogether, even at the higher optical densities at which such adhesion problems usually arise.

Accordingly, a first aspect of the present invention provides a thermal transfer printing receiver comprising a substrate having a surface on which is supported a receiver coat, the latter comprising a dye-receptive material and a dye-permeable release agent, characterised in that the receiver coat also contains dissolved or dispersed therein a Bisphenol A-based unsaturated polyester.

Bisphenol A is the trivial name by which 2.2'-bis(4-hydroxyphenyl) propane is commonly known, and unsaturated polyesters of Bisphenol A can be formed by condensing it with equivalent amounts of unsaturated dibasic acids, such as fumaric acid. However, for the present application we prefer to extend the Bisphenol A moiety before esterification by reacting it with two units of a short alkylene oxide, such as propylene or preferable ethylene oxide, thus to form an unsaturated polyester comprising an alkoxylated Bisphenol A polyester.

Condensation of a Bisphenol A or alkoxylated Bisphenol A with equivalent quantities of a dibasic unsaturated acid leads to linear polyester molecules. We prefer to stabilise the coating by lightly cross linking the polyester. Rather than use the ethylenic unsaturation of the dibasic acid, we prefer that the unsaturated polyester contains a polyfunctional constituent, which on polyesterification provides the unsaturated polyester with a degree of crosslinking. Such polyfunctional constituent is suitably included by replacing a small proportion (e.g. 0.1–10% by weight) of the Bisphenol A component of the unsaturated polyester by a polyhydric alcohol having a functionality greater than two, such as glycerol.

Particularly suitable unsaturated polyesters are the Atlac resins, especially Atlac 363E, an unsaturated polyester of ethoxylated Bisphenol A and fumaric acid, normally noted for its high peel strength and sold for adhesion promotion rather than as an anti-adhesion additive.

Generally only small quantities of the unsaturated polyesters are required, usually less than 10%, and typically around 5% by weight of the dye-receptive material forming the bulk of the receiver coat. Increasing amounts of the unsaturated polyester through suitable increments may be seen to increase progressively the protection from printing adhesion, as the size and frequency of the visible areas of adhering dyecoat become correspondingly reduced. The minimum quantity of additive required substantially to eliminate the visual effects of printing adhesion, is usually at least 1% by weight of the dye-receptive material, but we have found in practice that it is dependent partly on the nature of the dyecoat binder, and particularly on the dye-receptive component of the receiver coat; and hence will generally be different for different dyecoat/receiver coat combinations. We do, however, prefer to find the actual minimum effective quantity, and to use this when there is any danger of side effects, such as lowering of the Tg, as a result of adding excessive amounts of the unsaturated polyester to the receiver coat. Where this is no problem, however, further increases in the proportion of the additive may serve to provide a safety margin through its cumulative effect.

These unsaturated polyesters can be added to a wide variety of receiver coat compositions, examples of which are described in our copending EP-A-292 109. They are particularly suitable for use in compositions in which the dye-receptive material is a saturated polyester. Suitable commercial brands of saturated polyester include Vitel VPE200 (Goodyear), and Vylon 103 and Vylon 200 (Toyobo).

The above European application also describes the use of cross-linked silicone polymers as the release agent. These are particularly effective release agents, but with some dyesheets even these are not infallible, and they can be assisted very effectively by the incorporation of small quantities of the unsaturated polyester additives described herein.

EXAMPLES

The invention is illustrated first by the following set of four examples, in which Example 1 used no unsaturated polyester and is included here as a comparative example. The coating composition in all examples of this set comprised three precursor compositions, one for the dye-receptive saturated polyester, a second for a silicone resin and the third for a crosslinking agent reactive with the silicone resin to form a cross-linked silicone polymer release agent, these all being as set out below as solutions A, B and C. These component solutions in each case were mixed to provide a homogeneous composition shortly before being used. In Examples 2–4, a small amount of unsaturated polyester was also added as specified in the respective examples. These compositions were then coated onto white substrates of 125 μm thick Melinex 990 biaxially orientated polyethyleneterephthalate film, using a No. 5 K-bar. On drying, a coating thickness of about 3 μm was obtained. The coat was then cured to give a TTP receiver sheet with a receiver coat on one surface. Various cure conditions were tried, but these were found to make very little difference. Suitable conditions for all compositions were found to include temperatures of 150° C. for a period of 1 minute, 120° C. for a period of 6 minutes, and corresponding combinations of times and temperatures in between. Lower temperatures could also be used by employing suitable catalysts.

Each receiver sheet was printed using a set of standard dyesheets of three colours, yellow, magenta and cyan. Each dyesheet comprised a biaxially orientated polyethylene terephthalate substrate of about 6 μm thickness, having on one surface a backing coat with a high softening point and good release properties, and on the other a dyecoat comprising a dye in a polymeric binder. With the exception of one of the two sets of dyesheets used in Example 1, the binder in each case contained polyvinyl butyral.

Printing was carried out using a multi-pixel thermal printer in the normal manner. The receiver sheet and one of the dyesheets, with their respective receiver coat and dyecoat in contact, were together placed onto a rubber-covered drum of a thermal transfer printing machine, and contacted with a print head comprising a linear array of small heaters spaced apart at a linear density of 6 per mm, each heater being capable of being selectively activated individually in accordance with a pattern information signal, to transfer a small quantity of a dye to the receiver sheet and to form a single pixel of the pattern. In the tests, the heaters were activated for periods up to 10 ms to give temperatures reaching about 350° C. (power supply being 0.32 watt/pixel), thereby causing dye to transfer from the dyecoat of the dyesheet to the receiver coat of the receiver sheet held adjacent to it. This was repeated for each of the dyesheets in the set, the three colours being superimposed as each in turn was transferred to the receiver, thus to provide a full colour print.

The prints were then examined for printing adhesion. By comparing the colours with similar prints where no adhesion had occurred, differences in colour balance were visible where portions of a dyecoat had adhered, usually in areas where the true print had a solid block of one or more colours at high colour density. On examining the gloss of the print surface, areas of adhering dyecoat appeared matt. Initial diagnosis could also be confirmed by a variation of the so called Sellotape test, in which the adhesive surface of a strip of Sellotape adhesive tape is pressed against the surface of the print, and then pulled away. This is sufficient to remove any adhering pieces of dyecoat, but not the printed dye which is absorbed into the receiver coat.

Common to all the examples in this first set, was a basic precursor composition, to which unsaturated polyester was added as specified below. The basic precursor composition was as follows, where the quantities are given as parts by weight:

| | | |
|---|---|---|
| Solution A: | Vitel VPE200 | 9.0 parts |
| | toluene | 40.0 parts |
| | methyl ethyl ketone | 40.0 parts |
| Solution B: | amino silicone M468 | 0.39 parts |
| | toluene | 10.0 parts |
| Solution C: | Diepoxide 126 | 0.06 parts |
| | toluene | 10.0 parts |

EXAMPLE 1

In this comparative example, no unsaturated polyester was added. Receiver sheets were prepared as described above, and divided into two groups.

(a) A first group was printed using dyesheets in which the binder in the dyecoat was a cellulosic polymer, ethyl hydroxyethyl cellulose. No difficulty was experienced in separating the dyecoat from the receiver coat after printing, and there was no evidence of any printing adhesion having occurred with any of the prints made.

(b) The second group was printed using dyesheets having a binder containing polyvinyl butyral. After printing with each colour there was a reluctance for the sheets to part. The finished print had substantial areas with dyecoat adhering to the surface. These appeared as darkened matt areas on an otherwise glossy surface, and the edges of these areas were sharply defined. The prints could be cleaned up by applying Sellotape adhesive tape and withdrawing it. About one tenth of the area of the print was affected in this manner.

EXAMPLE 2

To the basic precursor composition was added Atlac 363E unsaturated polyester, in amount of 1% by weight of the Vitel saturated polyester. The composition as then coated onto the receiver substrates, dried, cured and printed as described above. There was again evidence of printing adhesion, but on all the prints made, this was noticeably less than was seen on the prints made in Example 1(b). The portions of dyesheet were adhering in similar positions, but the areas of contamination were smaller.

EXAMPLE 3

This was a repeat of Example 2 except that the quantity of Atlac unsaturated polyester added was 3% by weight of the Vitel saturated polyester. Further improvement was obtained in the print quality, the areas of contamination being smaller and fewer than in Example 2, but not entirely avoided.

EXAMPLE 4

This was a further repeat of Example 2 except that in this case the Atlac content was increased to 5% by weight of the Vitel. This gave clean prints, without any trace of any printing adhesion. When compared with the other uncontaminated prints obtained in Example 1(a), those obtained in this example seemed also to have a deeper colour, despite printing being carried out under similar conditions. However, this could have been due to the different dye binders used, rather than the presence or otherwise of the unsaturated polyester.

FURTHER EXAMPLES

The invention is further illustrated by the following set of examples, in which Example 5 used no unsaturated polyester and is included here as a further comparative example. The precursor compositions used in all the examples were as set out below, the component solutions in each case being mixed to provide a homogeneous composition shortly before being used. As before they were coated onto white substrates of 125 μm thick Melinex 990 film, using a No. 5 K-bar, and when dry the coating had a thickness of about 4 μm. Curing of the coat for all examples of this set was carried out at a temperature of 120° C. for a period of 6 minutes.

Each receiver sheet was printed with a magenta dyesheet, this being identified as having the dyecoat most likely to adhere to the receiver surface. This dyesheet comprised a biaxially oriented polyethylene terephthalate substrate of about 6 μm thickness, having on one surface a backing coat with a high softening point and good release properties, and on the other a subcoat coated with a dyecoat comprising a magenta dye mixture in a polyvinyl butyral binder. The subcoat prevents dye from diffusing into the substrate, and improves adhesion of the dyecoat to the support.

The receiver sheet and dyesheet, with their respective receiver coat and dyecoat in contact, were then placed together onto the rubber-covered drum of a thermal transfer printing machine, and printing carried out essentially as described for the first set, except that with using only a single (magenta) dyesheet, the sheets were passed only once through the printer. Printing was again carried out for increasing integer print times from 3 to 10 ms, producing a series of magenta bands, each corresponding to a particular print time.

The prints were then examined for printing adhesion. By comparing the magenta bands with those on similar prints where no adhesion had occurred, differences in colour intensity were visible where portions of the dyecoat had adhered, usually at the longer print times.

Common to all the examples in this second set, were three component solutions specified below as D, E and F, to which unsaturated polyester was added in Examples 6 and 7 as specified below. The basic precursor composition was as follows, were the quantities are given as parts by weight:

| | | |
|---|---|---|
| Solution D: | Vylon 200 | 12.9 parts |
| | toluene | 41.2 parts |
| | methyl ethyl ketone | 38.2 parts |
| Solution E: | amino silicone M468 | 0.55 parts |
| | toluene | 10.3 parts |
| Solution F: | Diepoxide 126 | 0.09 parts |
| | toluene | 10.3 parts |

EXAMPLE 5

In this comparative example, no unsaturated polyester was added. Receiver sheets were prepared and printed as described above. The printed sheet had areas with dyecoat adhering to the surface, beginning in the 8 ms band.

EXAMPLE 6

To the basic precursor composition was added Atlac 363E unsaturated polyester, in the amount of 3% by weight of the Vylon saturated polyester. The composition was then coated onto the receiver substrate, dried, cured and printed as described above. No adhesion of dyecoat to receiver surface was observed.

EXAMPLE 7

This was a repeat of Example 6 except that the quantity of Atlac unsaturated polyester added was 10% by weight of the Vylon saturated polyester. The coat quality was inferior to that obtained at the lower level. When printed, the dyesheet only adhered to the receiver surface in a very small area where a wetting problem had occurred on coating, exposing the base.

We claim:

1. A thermal transfer printing receiver comprising a substrate having a surface on which is supported a receiver coat, the latter comprising a dye-receptive material and a dye-permeable release agent, characterised in that the receiver coat also contains dissolved or dispersed therein an alkoxylated Bisphenol A-based unsaturated polyester.

2. A thermal transfer printing receiver as claimed in claim 1, characterised in that the unsaturated polyester comprises a polyester of ethoxylated Bisphenol A and fumaric acid.

3. A thermal transfer printing receiver as claimed in claim 1, characterised in that the unsaturated polyester contains a polyfunctional constituent which on polyesterification provides the unsaturated polyester with a degree of crosslinking.

4. A thermal transfer printing receiver as claimed in claim 3, characterised in that a small proportion of the Bisphenol A component of the unsaturated polyester is replaced by a polyhydric alcohol having a functionality greater than two, thereby to provide the crosslinking in the unsaturated polyester.

5. A thermal transfer printing receiver as claimed in claim 1, characterised in that the quantity of unsaturated polyester is within the range 1–10% by weight of the dye-receptive material.

6. A thermal transfer printing receiver as claimed in claim 1, characterised in that the dye-receptive material is a saturated polyester.

7. A thermal transfer printing receiver as claimed in claim 1, characterised in that the release agent is a cross-linked silicone polymer.

* * * * *